US006531090B2

(12) United States Patent
Ogawa

(10) Patent No.: US 6,531,090 B2
(45) Date of Patent: Mar. 11, 2003

(54) METHOD FOR PRODUCING POWDER COMPACT AND METHOD FOR MANUFACTURING MAGNET

(75) Inventor: Atsushi Ogawa, Osaka (JP)

(73) Assignee: Sumitomo Special Metals Co., Ltd. (JP)

( * ) Notice: Subject to any disclaimer, the term of this patent is extended or adjusted under 35 U.S.C. 154(b) by 0 days.

(21) Appl. No.: 09/783,399

(22) Filed: Feb. 15, 2001

(65) Prior Publication Data

US 2001/0041146 A1 Nov. 15, 2001

(30) Foreign Application Priority Data

Feb. 17, 2000 (JP) ..... 2000-039259

(51) Int. Cl.[7] ..... B22F 3/12
(52) U.S. Cl. ..... 419/38; 425/78
(58) Field of Search ..... 419/66, 38; 425/78

(56) References Cited

U.S. PATENT DOCUMENTS 5,383,978 A 1/1995 Yamamoto et al.

FOREIGN PATENT DOCUMENTS

| | | |
|---|---|---|
| JP | 06-081006 | 3/1994 |
| JP | 10-008102 | 1/1998 |
| JP | 10-152702 | 6/1998 |

*Primary Examiner*—Daniel J. Jenkins
(74) *Attorney, Agent, or Firm*—Nixon Peabody LLP; Jeffrey L. Costellia

(57) ABSTRACT

A method for manufacturing a magnet using an apparatus including a die, a first punch, and a second punch for compacting magnet powder is disclosed. Magnet powder is compacted with the first and second punches to produce a compact of the magnet powder. The distance between the first and second punches is increased to reduce the pressure applied to the compact from the first and second punches. Lowering of the die is started after the decrease of the pressure is started and before it is halted. The compact is completely ejected from the die before the pressure becomes zero.

29 Claims, 12 Drawing Sheets

METHOD FOR PRODUCING POWDER COMPACT AND METHOD FOR MANUFACTURING MAGNET

BACKGROUND OF THE INVENTION

The present invention relates to a method for producing a powder compact and a method for manufacturing a magnet, and also relates to a powder press used for compaction of powder and a method for driving the powder press. The present invention particularly relates to a compaction technique especially suitable for production of a compact having a shape in which the size measured in the pressing direction (direction in which uniaxial pressure is applied) is greater than the size in the direction perpendicular to the pressing direction (for example, a rod shape and a cylinder shape).

In the field of powder metallurgy, various methods have been employed for imparting a shape to powder. Among them, in particular, in the field of manufacture of sintered magnets, widely used is a method for compacting magnetic alloy powder (magnet powder) with a powder press.

A conventional method for producing a green compact of magnetic alloy powder will be described with reference to relevant drawings.

FIGS. 1A through 1C are cross-sectional views schematically illustrating the operation of a powder press of a withdrawal type. The press includes: a die 2 having a through hole for formation of a cavity 1: and an upper punch 3 and a lower punch 4 for compacting powder in the through hole. The press further includes an upper ram 5 and a lower ram 6 coupled to driving devices not shown. In the illustrated conventional example, the upper ram 5 is driven upward and downward together with the upper punch 3, while the lower ram 6 is driven upward and downward together with the die 2. The lower punch 4 is kept at a fixed position with respect to a main body 10 of the press.

Using the press having the above construction, a compact is conventionally produced in the following manner.

As shown in FIG. 1A, the top end portion of the lower punch 4 is located inside the through hole of the die 2 to define the cavity 1. The cavity 1 is filled with material powder. Next, as shown in FIG. 1B, the upper punch 3 is lowered to allow an end portion thereof to be inserted in the through hole of the die 2, so that the powder is compacted between the upper punch 3 and the lower punch 4 (uniaxial compaction). Thus, a green compact 7 of the filled powder is produced. Thereafter, as shown in FIG. 1C, a step of ejecting the compact 7 from the die 2 ("draw-out step" or "push-out step") is performed. In the illustrated conventional example, the die 2 is lowered while the lower punch 4 and the compact 7 are kept unmoved, and the upper punch 3 is lifted.

The above operation will be described in detail with reference to FIGS. 2A and 2B.

In FIG. 2A, lines A and B represent positions of the upper punch 3 and the die 2, respectively, and line C represents pressure P applied to the top end face of the compact 7. The compact 7 receives pressure, not only from the upper punch 3, but also from the lower punch 4 and the die 2. Herein, however, for convenience, only the pressure applied from the upper punch 3 to the compact 7 is specifically called "compact pressure", and the magnitude of the compact pressure is denoted by "P". The pressure P in FIG. 2A refers to this "compact pressure".

"S1", "S2", "S3", and "S4" in FIGS. 2A and 2B respectively represent the step of compacting powder, the step of lifting the upper punch 3 at a minimal speed, the step of ejecting the compact 7, and the step of lifting the upper punch 3 at a high speed. These steps will be described in order as follows.

In the step S1, the filled powder is compacted by applying a large pressure $P_C$ to the powder to form the compact 7. The compaction in a narrow definition is completed in this step. The compact 7 is in the state of being pressed inside the die 2. At time $t_1$, the step S2 is started where the upper punch 3 is lifted gradually at a minimal speed. With this gradual lift of the upper punch 3, the compact 7 in the pressed state expands as an elastic body in the direction opposite to the pressing direction. Once the compact pressure P reaches $P_H$ (>0), the minimal-speed lift of the upper punch 3 is halted.

At time $t_2$, the step S3 of ejecting the compact 7 is started. During this step, the compact 7 is held between the upper punch 3 and the lower punch 4, and the pressure $P_H$ of substantially a constant value is kept applied to the compact 7 from the upper and lower punches 3 and 4.

At time $t_3$, at which the compact 7 has been completely ejected from the die 2, the step S4 is started where the upper punch 3 is lifted at a high speed. With this highspeed lift of the upper punch 3, the compact pressure P abruptly drops, and becomes zero when the upper punch 3 is detached from the top end face of the compact 7.

The above compacting method is called a hold-down method (see "Powder Compaction and Processing—From Powder to Nearnet Shape" ed. by Japan Society for Technology of Plasticity and Japanese Laid-Open Patent Publication No. 6-81006), which has a feature that the compact 7 is ejected from the die 2 while a constant holding pressure ($P_H$) is applied to the compact 7 from the upper punch 3. This method can prevent "detaching fracture" of the compact 7, a phenomenon that may be generated in the course of ejecting the compact 7 from the die 2.

Hereinafter, the mechanism of generation of detaching fracture will be described with reference to FIGS. 3A and 3B.

FIG. 3A schematically illustrates the state where the die 2 that has just started moving downward applies friction to the periphery of the compact 7. FIG. 3B schematically illustrates the state where the top end portion of the compact 7 is exposed outside as the lowering of the die 2 proceeds. Since the pressed compact 7 is an elastic body, it tends to expand in the direction shown by arrow $Q_1$ as a pressure $P_1$ applied to the compact 7 from the upper punch 3 decreases (springback phenomenon). Once the pressure $P_1$ is removed, leaving the top end face of the compact 7 free, the compact 7 is forced to expand outward from the die 2. At the same time, the periphery of the compact 7 receives strong friction from the die 2. As a result, local strain occurs inside the compact 7, forming a crack 8. This crack 8 causes generation of detaching fracture.

To prevent generation of detaching fracture, in the hold-down method, application of a predetermined holding pressure $P_H$ to the compact 7 is continued until completion of the step S3 of ejecting the compact 7. This conventional hold-down method has been employed for compaction of high-hardness powder such as ceramic powder and intermetallic compound powder that are high in hardness, hard to develop plastic deformation, and poor in ductility, and has delivered sufficient effects.

However, the above conventional method has the following problem. When the pressed density of the compact is comparatively low as in the case of manufacturing an anisotropic rare earth magnet, buckling (collapse) of the compact tends to be generated. In the case of manufacturing an anisotropic rare earth magnet, powder is aligned in a magnetic field during compaction. In this case, a lubricant is added to the magnet powder, and also the compacting density is reduced by compacting the powder at a low pressure, to thereby improve the alignment of powder particles. In this case, since the compact strength is weakened, buckling may be generated in the resultant compact even with application of a comparatively small pressure.

In recent years, with expanding use of magnets, there arises the need for producing compacts having a shape elongated in the pressing direction (direction of movement of the punch). Herein, for convenience, the size of a compact measured in the pressing direction is called the "compact height", and a typical size of the compact measured in the direction perpendicular to the pressing direction is called the "compact width" or "compact diameter". The face of the compact in contact with the upper punch is called the "compaction face", and the extent thereof is called the "compaction area".

When the "compact width" and the "compaction area" are fixed, as the "compact height" is increased, buckling of the compact is more likely to be generated with application of pressure in the pressing direction during the step of ejecting the compact. FIG. 4A illustrates the state where pressures $P_1$ and $P_2$ are applied to a compact having a comparatively small compact height, and FIG. 4B illustrates the state where pressures $P_1$ and $P_2$ are applied to a compact having a comparatively large compact height. The trouble of buckling occurs significantly more often in the case of FIG. 4B, compared with the case of FIG. 4A.

The magnitude of the pressure in the pressing direction with which buckling of a compact is generated, that is, the buckling strength (collapse strength) decreases as the portion of the compact 7 exposed outside from the die 2 increases in the course of ejecting the compact 7 from the die 2. Therefore, in the step S3 where the compact 7 is gradually ejected while the holding pressure $P_H$ (constant pressure) is applied to the compact 7 so as to avoid generation of detaching fracture, buckling may not be generated in the initial stage of the step S3. However, in the latter stage of this step, there arises the possibility of generating buckling or collapse. In the latter stage of the ejecting step S3, a large part of the compact has been exposed, and the compact tends to be collapsed even when the applied holding pressure $P_H$ is comparatively small. The larger the compact height is, the higher the possibility of generating buckling is.

FIG. 5A shows the ranges of the compact pressure P in which detaching fracture is generated (detaching generation region) and buckling is generated (buckling generation region). In FIG. 5A, the holding pressure $P_H$ is set at a value that circumvents the detaching generation region. In the case shown in FIGS. 5A and 5B, however, since the buckling strength decreases with the progress of the ejection of the compact 7, the holding pressure $P_H$ finally enters the buckling generation region. This means that buckling is generated in the compact 7 in the latter stage of the ejecting step. If the holding pressure $P_H$ is lowered to avoid buckling, it enters the detaching generation region, causing detaching fracture this time. This problem does not arise in the case where the ratio of the "compact height" to the "compact width" or the "compaction area" is small and in the case where the compact strength is high, because in these cases, the buckling generation region shown in FIG. 5A is shifted upward.

Japanese Laid-Open Patent Publication No. 10-8102 describes control of the magnitude of the holding pressure during ejection of a compact from a die based on the height of the portion of the compact exposed from the die. However, according to an experiment by the present inventors, where compacts were ejected by the method described in the above publication, detaching fracture was generated in some cases at the start of exposure of the compact from the die. In particular, this phenomenon was often generated in the case of ejecting elongated compacts having a large ratio of the "compact height" to the "compact width" or the "compaction area" from the die.

In view of the above, it is considered necessary to control the holding pressure at the start of exposure of the compact. However, while the above publication describes control of the holding pressure after the compact has been exposed based on the height of the exposed portion of the compact, no mention is made on control of the holding pressure before the compact has been exposed.

The required holding pressure $P_H$ is markedly small compared with the pressure $P_C$ applied during compaction. However, it is very difficult to regulate the compact pressure P with high precision. Conventionally, the upper punch 3 and the die 2 are often driven with hydraulic devices. In this type of press, a conventionally adopted detects the hydraulic pressure of a compression cylinder and calculates the pressure P applied to the compact 7 based on the magnitude of the hydraulic pressure. This method is described in Japanese Laid-Open Patent Publication No. 10-152702, for example.

However, the hydraulic pressure detected in the above method varies with the mechanical resistance load received by the upper punch 3 and the die 2 when these members are driven, and thus it is difficult to precisely determine the pressure P that is being applied to the compact 7. Therefore, a new method is required to precisely detect the pressure P that is actually being applied to the compact 7 for prevention of detaching and buckling.

SUMMARY OF THE INVENTION

A primary object of the present invention is to provide a method for producing a powder compact and a method for manufacturing a magnet, where detaching fracture and buckling are reduced during ejection of a compact than in the prior art.

Another object of the present invention is to provide a powder press capable of detecting the pressure being applied to a powder compact with high precision and controlling the operation of a pressurizing member based on the detection results, and a method for driving such a powder press.

The present invention relates to a method for producing a powder compact and an apparatus for producing the same including a die having a through hole for formation of a cavity and first and second punches for compacting powder in the through hole. The method includes the steps of: filling the cavity with the powder in a state where at least an end portion of the second punch is located in the through hole of the die; producing a compact of the powder by inserting at least an end portion of the first punch in the through hole of the die and compacting the powder between the first and second punches; increasing the distance between the first and second punches while applying a pressure to the compact from the first and second punches, to thereby decrease the pressure; and starting relative movement of the die with respect to the compact after the decrease of the pressure is started and before the decrease of the pressure is halted, and completing ejection of the compact from the through hole of the die before the pressure becomes zero.

In a preferred embodiment, the relative movement of the die with respect to the compact is started when a preset time has elapsed from a time point at which the increase of the distance between the first and second punches is started.

Alternatively, the relative movement of the die with respect to the compact may be started when the pressure drops to a preset first level by increasing the distance between the first and second punches.

In a preferred embodiment, during the progress of the relative movement of the die with respect to the compact, the second punch is kept unmoved while the die is moved.

Alternatively, during the progress of the relative movement of the die with respect to the compact, the die may be kept unmoved while the second punch is moved.

In a preferred embodiment, the increase of the distance between the first and second punches is halted when the pressure drops to a preset second level by increasing the distance between the first and second punches.

Preferably, the pressure is detected based on an output of a strain sensor attached to at least one of the first and second punches.

In a preferred embodiment, the powder is magnet powder.

Preferably, the magnet powder is rare earth alloy powder having a mean particle size of 5 $\mu$m or less.

Preferably, the magnet powder is produced by quenching alloy molten mass.

A lubricant is preferably added to the powder.

The method may further include the step of sintering the powder compact.

A magnetic field for alignment may be applied to the powder during the compaction of the powder between the first and second punches.

Preferably, the direction of the magnetic field for alignment in the cavity is substantially perpendicular to a pressing direction of the first and second punches against the compact.

Alternatively, the method for manufacturing a magnet of the present invention is a method for manufacturing a magnet using an apparatus including a die, a first punch, and a second punch for compacting magnet powder. The method includes the steps of: producing a compact of the magnet powder by compacting the magnet powder with the first and second punches; increasing the distance between the first and second punches to thereby decrease a pressure applied to the compact from the first and second punches; and starting relative movement of the die with respect to the compact after the decrease of the pressure is started and before the decrease of the pressure is halted, and completing ejection of the compact from the die before the pressure becomes zero.

Preferably, in the step of producing a compact of the magnet powder by compacting the magnet powder with the first and second punches, a magnetic field for alignment having a direction perpendicular to a pressing direction is generated.

In the step of producing a compact of the magnet powder by compacting the magnet powder with the first and second punches, a compact in a plate shape may be produced where a size measured in the direction parallel to the direction of the magnetic field for alignment is smaller than a size measured in any other direction.

The powder press of the present invention includes a die having a through hole for formation of a cavity and first and second punches for compacting powder in the through hole. The press executes the steps of: filling the cavity with the powder in a state where at least an end portion of the second punch is located in the through hole of the die; producing a compact of the powder by inserting at least an end portion of the first punch in the through hole of the die and compacting the powder between the first and second punches; increasing the distance between the first and second punches while applying a pressure to the compact from the first and second punches, to thereby decrease the pressure; and starting relative movement of the die with respect to the compact after the decrease of the pressure is started and before the pressure drops to a preset level, and completing ejection of the compact from the through hole of the die while the pressure is at the preset level.

In a preferred embodiment, the relative movement of the die with respect to the compact is started when a preset time has elapsed from a time point at which the increase of the distance between the first and second punches is started.

The relative movement of the die with respect to the compact may be started when the pressure drops to a preset first level by increasing the distance between the first and second punches.

In a preferred embodiment, during the progress of the relative movement of the die with respect to the compact, the second punch is kept unmoved while the die is moved.

During the progress of the relative movement of the die with respect to the compact, the die may be kept unmoved while the second punch is moved.

In a preferred embodiment, the increase of the distance between the first and second punches is halted when the pressure drops to a preset second level by increasing the distance between the first and second punches.

Preferably, the powder press further includes a strain sensor attached to at least one of the first and second punches, wherein the pressure is detected based on an output of the strain sensor.

Alternatively, the powder press of the present invention includes a die, a first punch, and a second punch for compacting powder, wherein the powder press further includes a sensor attached to at least one of the first and second punches for detecting strain of the punch, and a pressure applied to the powder from the first and second punches is determined based on an output of the sensor, for control of operations of the first and second punches.

DETAILED DESCRIPTION OF THE INVENTION

Hereinafter, an embodiment of the present invention will be described with reference to the relevant drawings.

Figure 1A:
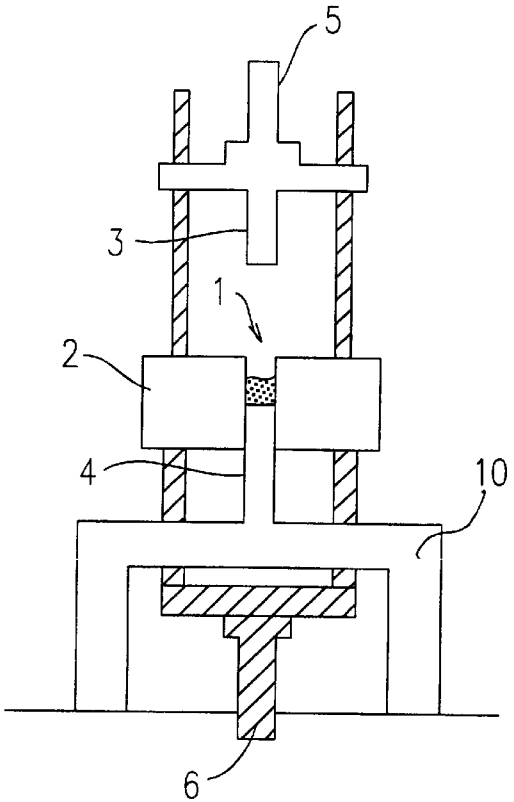
FIGS. 1A through 1C are cross-sectional views illustrating the steps of the operation of a powder press.
Figure 1B:
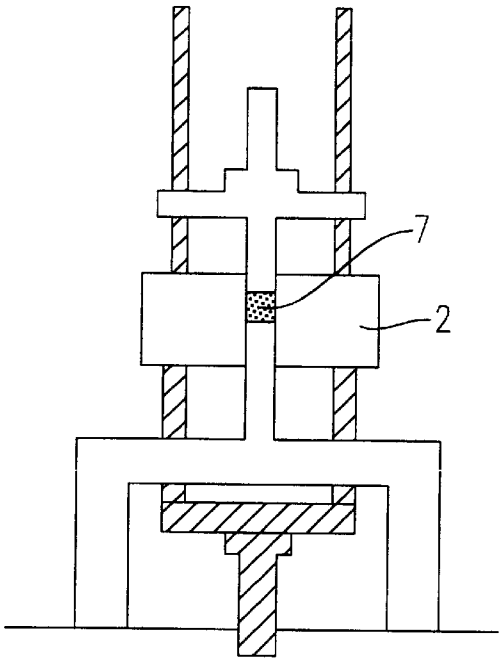
Figure 1C:
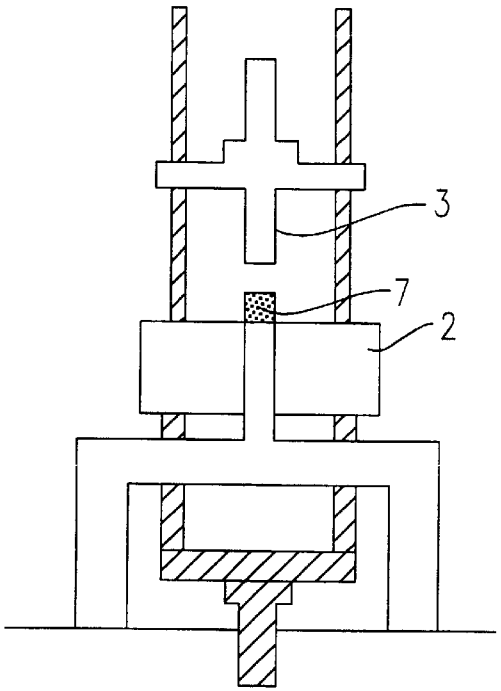

A powder press used in this embodiment of the invention has basically the same construction as that shown in FIG. 1. Therefore, the construction and operation of the press used in this embodiment will be described with reference to FIG. 1 using the same reference numerals for corresponding components.

The press used in this embodiment includes a die 2 having a through hole for formation of a cavity 1, an upper punch 3 and a lower punch 4 for compacting powder in the through hole, and an upper ram 5 and a lower ram 6 coupled to driving devices not shown, as shown in FIG. 1. In this embodiment, as in the conventional case described above, the upper ram 5 serves to move the upper punch 3 upward and downward, while the lower ram 6 serves to move the die 2 upward and downward. The lower punch 4 is kept at a fixed position with respect to a main body 10 of the press.

Figure 2A:
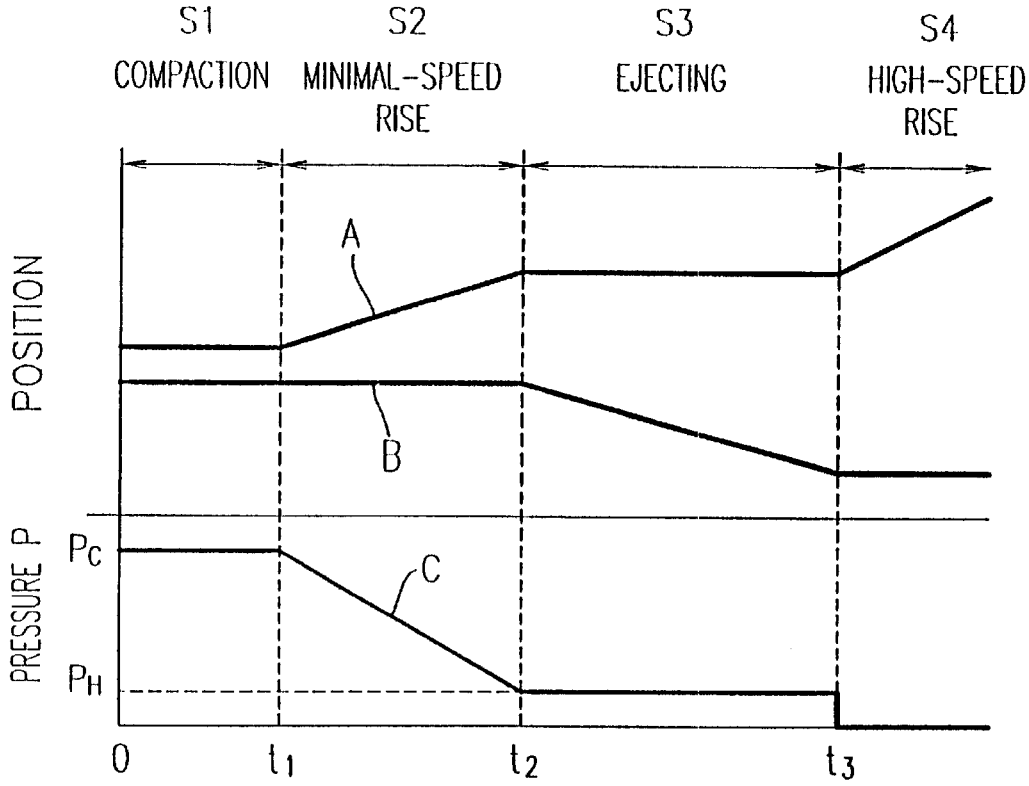
FIGS. 2A and 2B are views illustrating conventional operation of the powder press of FIG. 1, where the x-axis represents the time and the y-axis represents the position of an upper punch (line A), the position of a die (line B), and the pressure applied to a compact (line C).
Figure 2B:
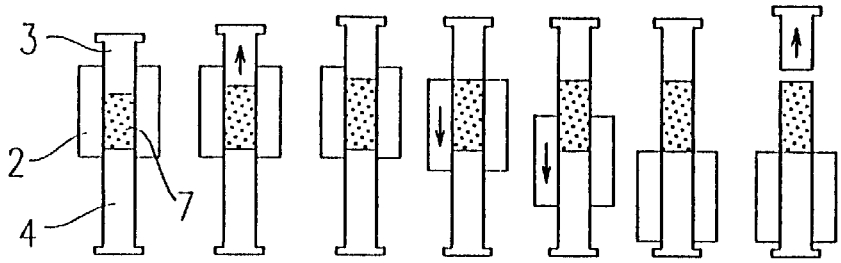
Figure 3A:
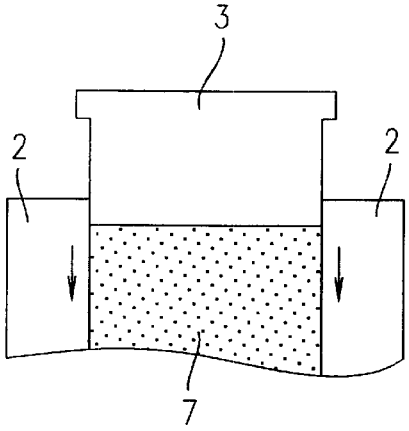
FIGS. 3A and 3B are cross-sectional views schematically illustrating the state where a die 2 moving downward applies friction to the periphery of a green compact 7, and the state where the top end portion of the compact 7 is exposed outside from the die 2 as the lowering of the die 2 proceeds, respectively.
Figure 3B:
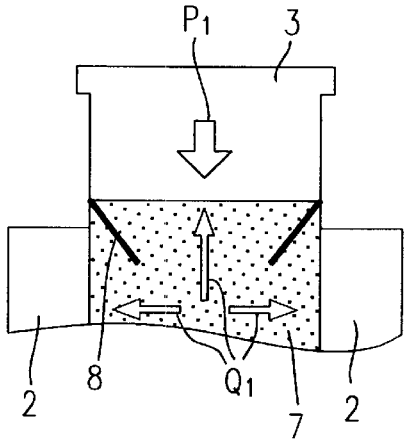
Figure 4A:
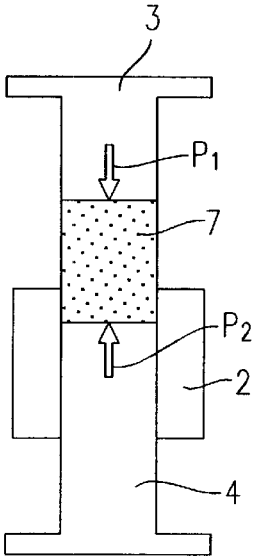
FIGS. 4A and 4B are cross-sectional views illustrating the states where pressures $P_1$ and $P_2$ are applied to a compact having a comparatively small compact height and a compact having a comparatively large compact height, respectively.
Figure 4B:
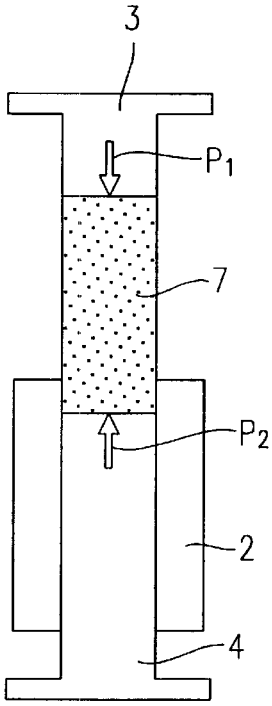
Figure 6A:
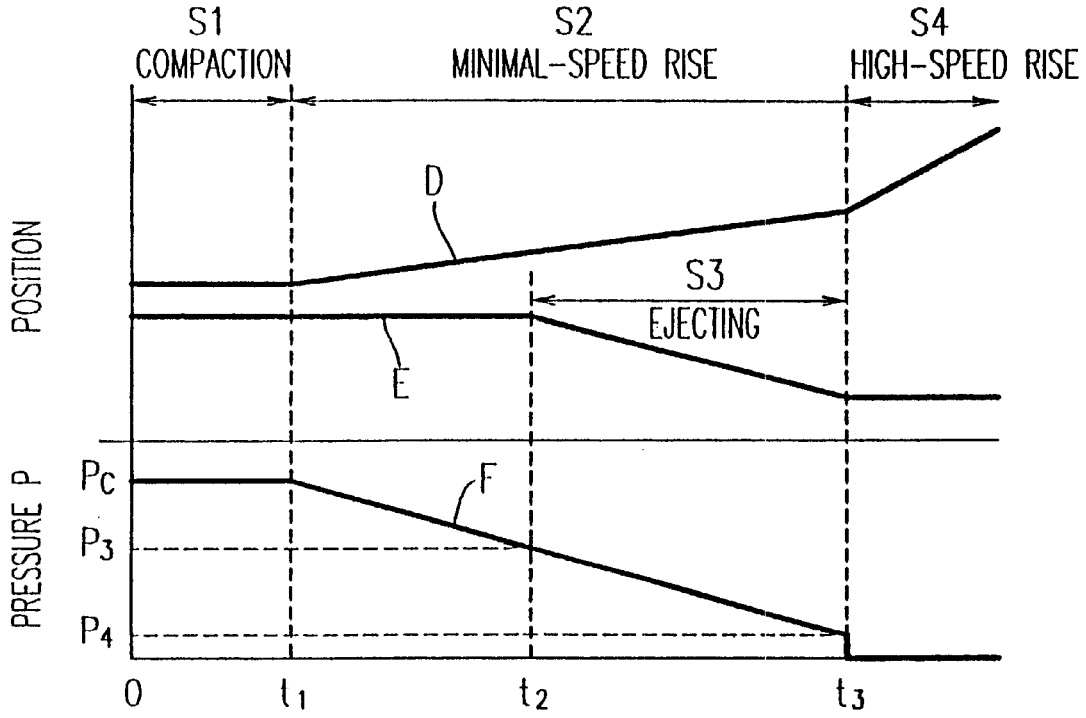
FIGS. 6A and 6B are views illustrating the operation of an embodiment of a powder press of the present invention, where the x-axis represents the time and the y-axis represents the position of the upper punch (line D), the position of the die (line E), and the pressure applied to the compact (line F).
Figure 6B:
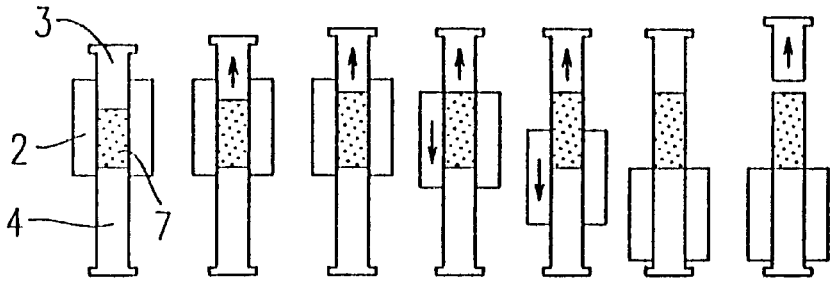

FIGS. 6A and 6B are views illustrating the operation of the press used in this embodiment, which corresponds to FIGS. 2A and 2B referred to in the description of the conventional press of the withdrawal type. In FIG. 6A, lines D and E represent positions of the punch 3 and the die 2, respectively, and line F represents the pressure applied to the compaction face of the compact 7. "S1", "S2", "S3", and "S4" in FIG. 6A respectively represent the step of compacting powder, the step of lifting the upper punch 3 at a minimal speed, the step of ejecting the compact 7, and the step of lifting the upper punch 3 at a high speed.

As is found from FIGS. 6A and 6B, a feature of this embodiment is that the step S3 of ejecting the compact is started before completion of the step S2 of lifting the upper punch 3 at a minimal speed. In this embodiment, filling of the cavity 1 with powder and compaction of the powder are performed in the conventional manner. Note that, in the case of manufacturing a magnet using rare earth alloy powder, the compact pressure $P_C$ in the step of compacting powder is set in the range of 10 MPa to 300 MPa.

Hereinafter, only steps distinctive in this embodiment will be described.

After completion of the compaction in the step S1 of compacting powder, the step S2 of lifting the upper punch 3 at a minimal speed is started at time $t_1$. The upper punch 3 is slowly lifted as represented by the line D, while the pressure to the compact 7 is gradually reduced from the compact pressure $P_C$. During the minimal-speed lift of the upper punch 3, the compact 7 expands in the direction opposite to the pressing direction as a pressed elastic body, and therefore the upper punch 3 and the top end face of the compact 7 are kept in contact with each other. At time $t_2$ ($t_1<t_2$) at which the pressure applied to the compact 7 from the upper punch 3 is in the midst of gradual decrease, lowering of the die 2 is started to initiate the step S3 of ejecting the compact 7. In this embodiment, the timing at which the step S3 is started is controlled using a timer. That is, the elapsed time is counted from the start of the step S2 of lifting the upper punch 3 at a minimal speed. When the elapsed time reaches a predetermined value, lowering of the die 2 is started to initiate the step S3 of ejecting the compact 7.

Thus, in this embodiment, the ejecting step S3 is started after the pressure P applied to the compact 7 starts decreasing. If the timing of the start of the step S3 is too late, the decrease of the pressure P proceeds too much, causing the possibility of generation of detaching fracture. The ejecting step S3 therefore needs to be started before the compact pressure excessively decreases. In this embodiment, this timing control is done by use of a timer. Alternatively, this may be done by other ways such as detecting the compact pressure P.

In this embodiment, the distance between the upper punch 3 and the lower punch 4 at the time ($t_2$) of start of the step S3 of ejecting the compact 7 is smaller than that at the time at which part of the compact 7 is first exposed outside of the die 2. In this way, the compact pressure P at time $t_2$ is regulated to be large enough to prevent generation of detaching fracture in the compact 7.

In this embodiment, the step S2 of lifting the upper punch 3 at a minimal speed continues even during the execution of the ejecting step S3. Therefore, during the step S3, the distance between the upper punch 3 and the lower punch 4 gradually increases thereby gradually reducing the pressure P. This means that as the height of the portion of the compact 7 exposed outside from the die 2 is greater, the pressure P applied to the compact is smaller. This makes it possible to eject a compact elongated in the pressing direction from the die 2 without generating buckling. In this embodiment, an elongated compact having a height of 80 mm or more, which would not have been easily obtained conventionally, can be ejected without generating collapse/buckling.

After completion of the step S3 of ejecting the compact 7, at time $t_3$, the step S4 of lifting the upper punch 3 at a high speed is started.

In this embodiment, the compact pressure P at the time ($t_3$) at which the ejecting step S3 is completed is larger than zero, but sufficiently smaller than the compact pressure P at the time ($t_2$) at which the ejecting step S3 is started.

Figure 5A:
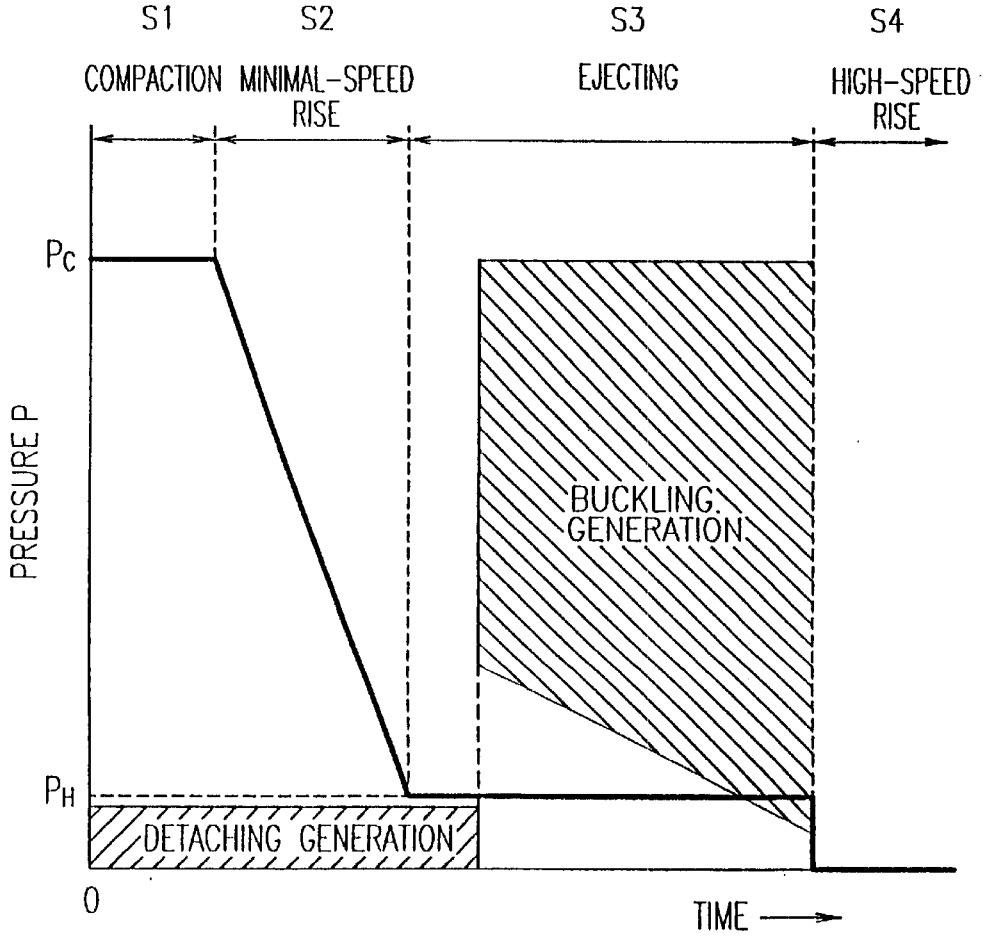
FIGS. 5A and 5B are views illustrating the relationship between the pressure applied to the compact 7 from an upper punch 3 in conventional operation and the pressures at which detaching fracture and buckling are generated.
Figure 5B:
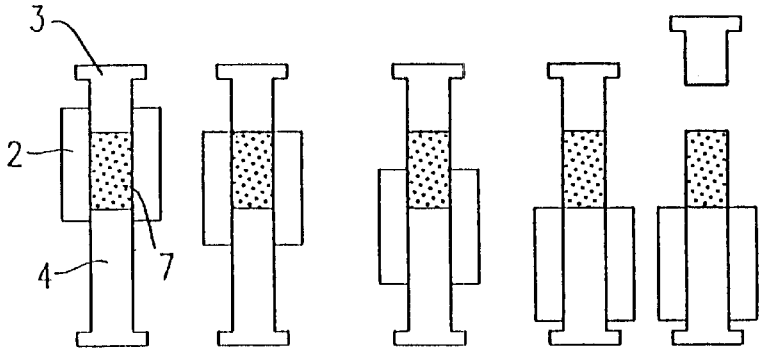

Detaching fracture tends to be generated immediately after the top end portion of the compact 7 is exposed outside from the die 2. This is presumably because the top end portion of the compact 7 is relatively low in strength compared with the other portion thereof. In addition, the pressing force of the upper punch 3 against the compact 7 is temporarily weakened when the step S3 of ejecting the compact 7 has just started, that is, in this embodiment, when the lowering of the die 2 has just started. This is presumably because the compact 7 is momentarily pressed downward due to static friction existing between the die 2 and the periphery of the compact 7. In the conventional operation, when the pressing force of the upper punch 3 against the compact 7 is weakened at the start of the ejecting step S3 for the above reason, the compact pressure P may temporarily fall into the detaching generation region shown in FIG. 5A, possibly resulting in generation of detaching fracture. In this embodiment, however, the compact pressure P at the start of the ejecting step S3 ($t_2$) can be set at a value sufficiently larger than the level at which detaching fracture may be generated. Accordingly, generation of detaching fracture can be avoided even when the pressure is temporarily reduced at the start of the ejecting step S3.

In addition, from an experiment by the present inventors, it was found that the phenomenon of the pressing force of the upper punch 3 against the compact 7 being temporarily weakened could be eased by starting the lowering of the die 2 while the upper punch 3 was lifted (that is, while the pressure P applied to the compact 7 in the die 2 was reduced). If the lowering of the die 2 is started while the upper punch 3 is not lifted, the pressure applied to the compact sharply decreases. On the contrary, when the lowering of the die 2 is started while the upper punch 3 is lifted, the pressure applied to the compact decreases more slowly. Accordingly, in this embodiment, the possibility that the pressure applied to the compact has been sharply reduced is small at the time of the start of exposure of the compact. It is therefore possible to appropriately prevent generation of detaching fracture.

Although the lines D, E, and F are shown as straight lines in FIG. 6A, they may be curved lines. Actually, when the upper punch 3 is lifted at a constant minimal speed, the compact pressure P decreases in a curved line due to the elastic nature of the compact 7.

Figure 7A:
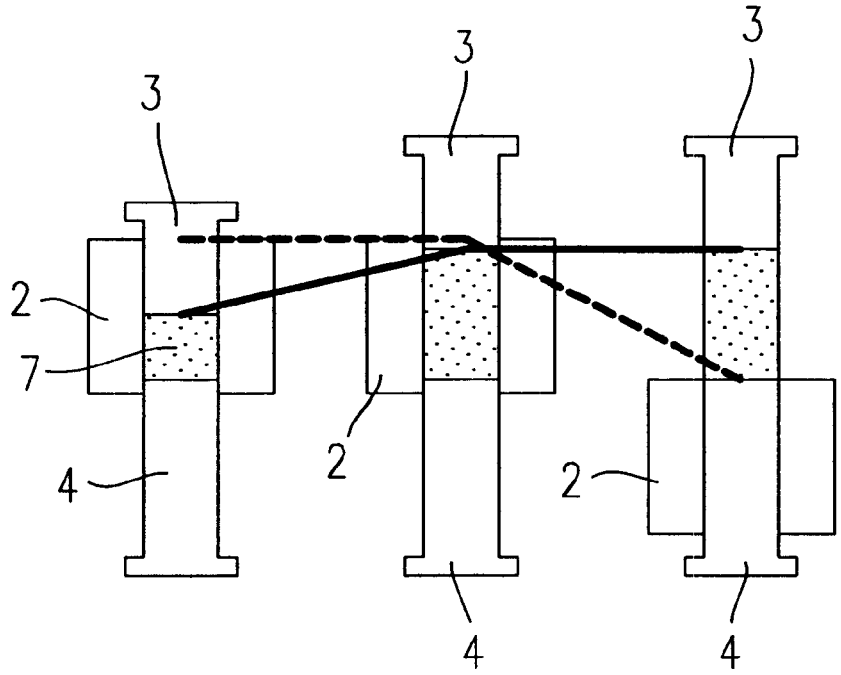
FIGS. 7A and 7B are schematic cross-sectional views illustrating upward and downward operations of the die 2, the upper punch 3, and the lower punch 4 in conventional operation and in an embodiment of the present invention, respectively.
Figure 7B:
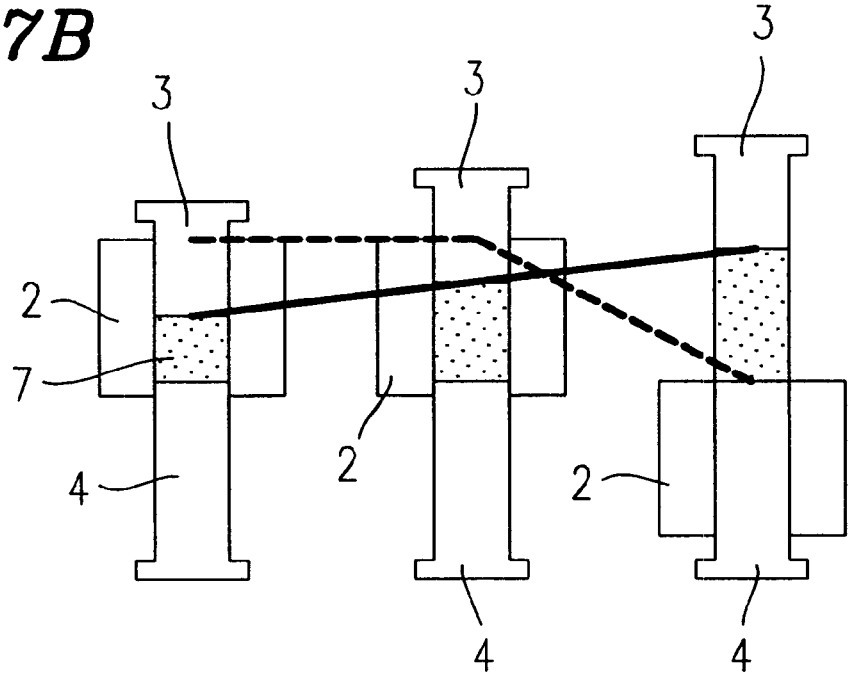

Next, with reference to FIGS. 7A and 7B, the operation in this embodiment is compared with the conventional operation. FIG. 7A is a schematic cross-sectional view illustrating the conventional upward and downward operations of the die 2, the upper punch 3, and the lower punch 4. FIG. 7B is a schematic cross-sectional view illustrating the upward and downward operations of the die 2, the upper punch 3, and the lower punch 4 in this embodiment. The bold solid lines in FIGS. 7A and 7B indicate how the position of the bottom end face of the upper punch 3 is shifted with time, while the bold broken lines indicate how the position of the top end face of the die 2 is shifted with time.

In the case of FIG. 7A, the upper punch 3 is lifted at a minimal speed for three seconds, for example, and then ejection of the compact 7 (lowering of the die 2) is performed for six seconds, for example. The upper punch 3 is lifted at a speed of about 1 mm/sec, for example, during the minimal-speed lift, and the die 2 is lowered at a speed of about 20 mm/sec, for example, during the ejection of the compact.

In the case of FIG. 7B, the upper punch 3 is lifted at a minimal speed for nine seconds, for example. Ejection of the compact 7 (lowering of the die 2) is started three seconds, for example, after the start of the minimal-speed lift of the upper punch 3, and is completed in six seconds, for example. The upper punch 3 is lifted at a speed of about 0.5 mm/sec, for example, for the first three seconds of the minimal-speed lift, and at a speed of about 0.3 mm/sec, for example, for the next six seconds (during the ejection of the compact 7). During the ejection of the compact 7, the die 2 is lowered at a speed of 20 mm/sec, for example.

From FIGS. 7A and 7B, the following is shown. The compact 7 is ejected by lowering the die 2 in both cases. However, while the period during which the upper punch 3 is lifted at a minimal speed does not overlap the period during which the die 2 is lowered in the case of FIG. 7A, these periods overlap each other in the case of FIG. 7B.

In this embodiment, the compact 7 is ejected by lowering the die 2. The present invention is not limited to this operation. Since the ejection of the compact 7 is realized by moving the die 2 with respect to the compact 7, the die 2 may be fixed while the lower punch 4 is lifted.

Hereinafter, with reference to FIGS. 8A and 8B, another embodiment of the invention where the die 2 is fixed will be described.

Figure 8A:
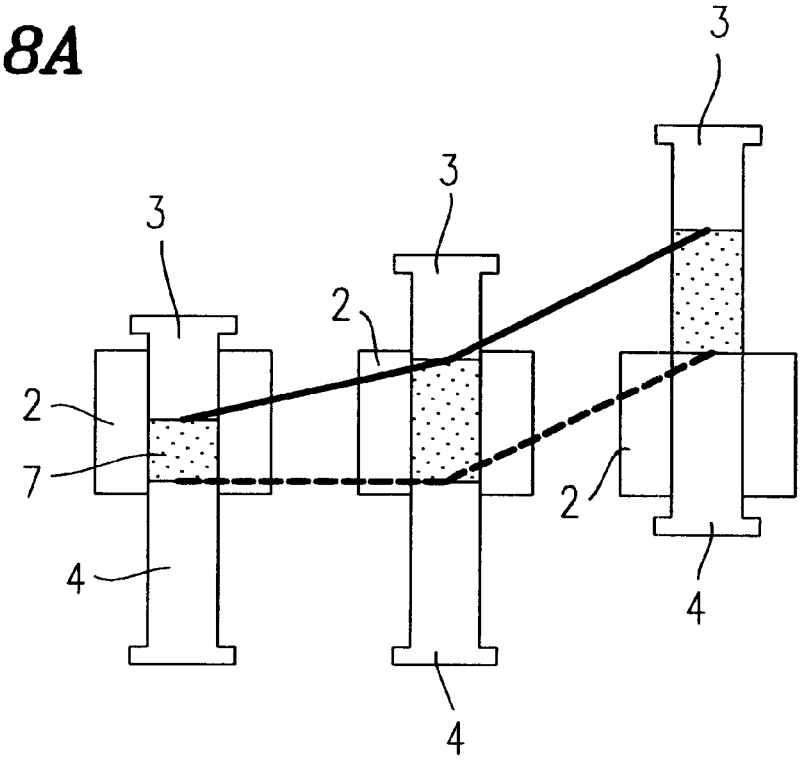
FIGS. 8A and 8B are schematic cross-sectional views illustrating conventional operation where the upper punch 3 and the lower punch 4 are lifted while the die 2 is kept unmoved during ejection of the compact 7, and the operation in another embodiment of the present invention where the upper punch 3 is lifted faster than the lower punch 4 while the die 2 is kept unmoved during ejection of the compact 7.

FIG. 8A illustrates a conventional operation where the upper punch 3 and the lower punch 4 are lifted at a same speed during the ejection of the compact 7. The compact 7 is ejected from the die 2 with the lift of the lower punch 4. During the ejection of the compact 7, the upper punch 3 and the lower punch 4 are kept at a constant distance, and thus the compact pressure P is kept at the holding pressure $P_H$. In this case, therefore, the compact pressure P changes as shown by line C in FIG. 2.

Figure 8B:
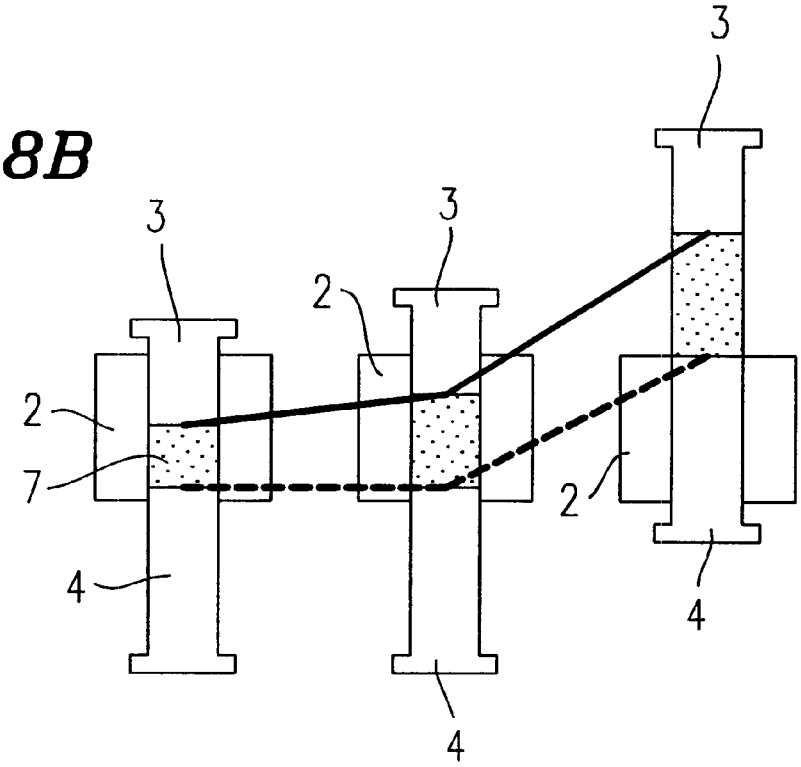

FIG. 8B illustrates the operation in an embodiment of the present invention. In this embodiment, the upper punch 3 and the lower punch 4 are lifted at different speeds during the ejection of the compact 7. More specifically, the lifting speed of the upper punch 3 is controlled to be greater than the lifting speed of the lower punch 4. This results in gradual increase of the distance between the upper punch 3 and the lower punch 4. The compact pressure P therefore changes as shown by line F in FIG. 6, and thus the same effect as that described in the first embodiment is obtained.

In FIG. 8B, the lifting speed of the upper punch 3 during the step of ejecting the compact can be set at a value (e.g., about 20 mm/sec) markedly higher than the lifting speed of the upper punch 3 adopted before the start of the ejecting step (e.g., about 1 mm/sec). Therefore, the "minimal-speed lift" as used herein also includes a lift of the upper punch 3 at a high speed as long as the relative speed of the upper punch 3 with respect to the lower punch 4 is comparatively low. Herein, therefore, note that the "minimal-speed lift" of the upper punch 3 is defined as any operation of extending the distance between the upper punch 3 and the lower punch 4 while both the upper punch 3 and the lower punch 4 are in contact with the compact 7.

An important point of the present invention is to control the relative positional relationships among the die 2, the upper punch 3, and the lower punch 4 in the manner described above. Therefore, it is also possible to combine the operation shown in FIG. 7B with the operation shown in FIG. 8B. That is, the upper punch 3 and the lower punch 4 may be lifted while the die 2 is lowered. Alternatively, the press may be installed at a position rotated by 90° so that the punches and the like are driven in the horizontal direction.

Figure 9:
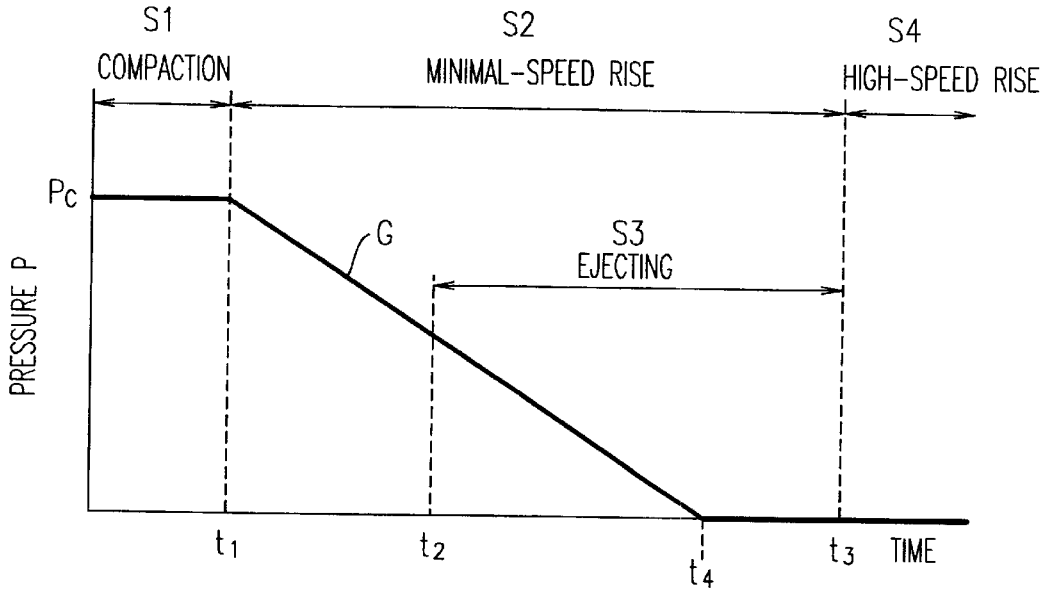
FIG. 9 is a view illustrating a case where the compact pressure P becomes zero at time $t_4$ in the middle of the step S3 of ejecting the compact.
Figure 11A:
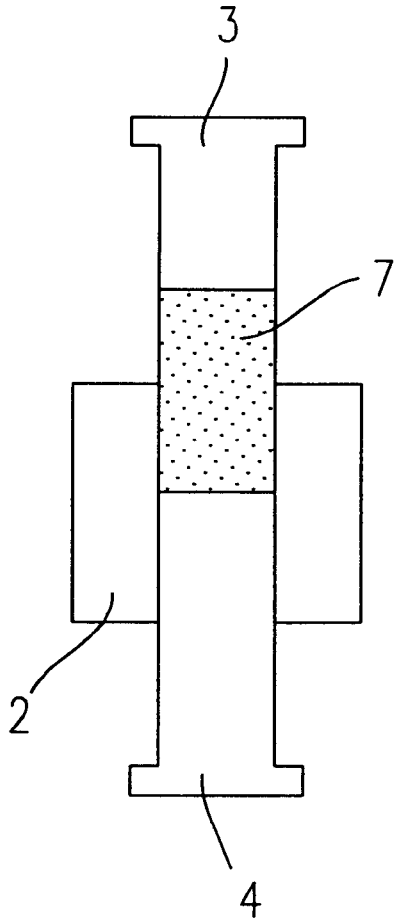
FIGS. 11A and 11B are cross-sectional views illustrating the positional relationships among the upper punch 3, the compact 7, and the like at a time point from time $t_2$ to time $t_4$ and at a time point from time $t_4$ to time $t_3$, respectively, in the case where the pressure change shown in FIG. 9 occurs.
Figure 11B:
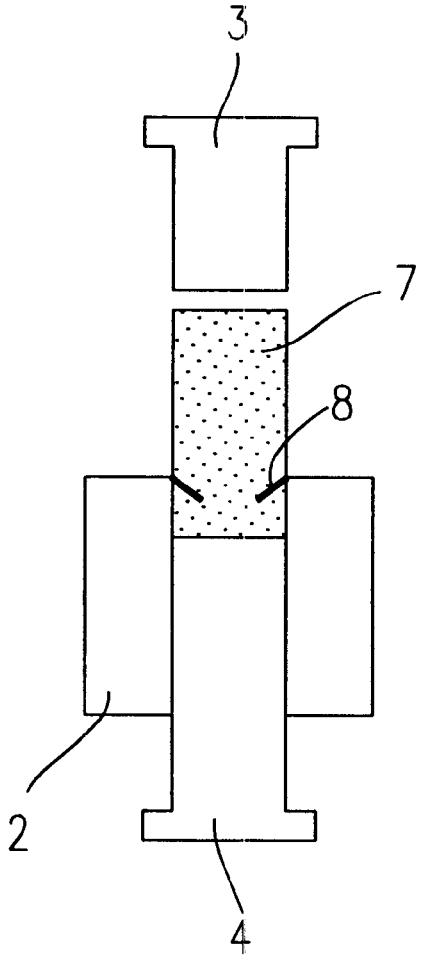

FIG. 9 illustrates the case where the compact pressure P becomes zero at time $t_4$ in the middle of the step S3 of ejecting the compact 7. When the compact pressure P becomes zero before the compact 7 has been completely ejected, detaching fracture may possibly be generated. FIGS. 11A and 11B illustrate the positional relationships among the upper punch 3, the compact 7, and the like observed when the pressure P changes as shown in FIG. 9. In the state shown in FIG. 11A, the compact 7 is sandwiched by the upper punch 3 and the lower punch 4. In this state, therefore, the compact pressure P is greater than zero. Thereafter, when the upper punch 3 is detached from the top end face of the compact 7 before completion of the ejection of the compact 7 as shown in FIG. 11B, the compact pressure P becomes zero. The top end face of the compact 7 is now free, losing the force suppressing springback of the compact 7. On the contrary, part of the compact 7, which receives strong friction from the die 2, is prevented from free volume change. As a result, large local strain is generated inside the compact 7, which possibly causes formation of a crack 8.

Figure 10:
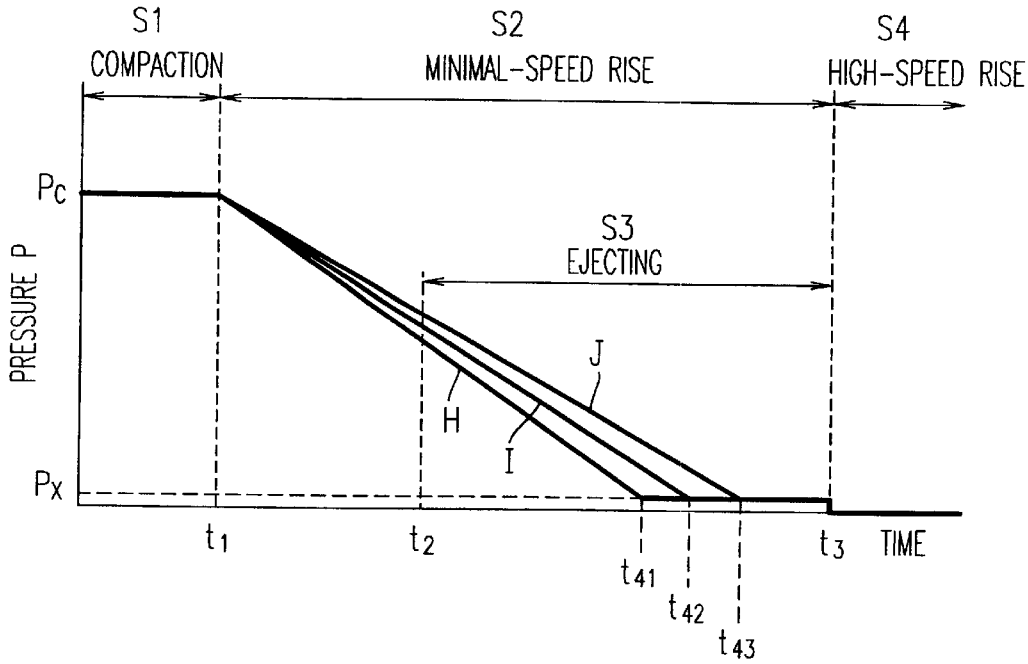
FIG. 10 is a view illustrating a change in pressure observed when the press has been controlled so that the compact pressure P will not be below a preset level $P_X$ in the case where the pressure P has dropped to the level $P_X$ in the middle of the step S3 of ejecting the compact.

In order to prevent formation of the crack 8, the pressure P applied to the compact 7 from the upper punch 3 is preferably kept at a predetermined level or higher until the ejection of the compact 7 is completed. FIG. 10 illustrates a pressure change observed in an embodiment where the press is controlled so that the compact pressure P will not be below a preset level $P_X$ in the case where the pressure P has dropped to the level $P_X$ in the middle of the step S3 of ejecting the compact.

In order to achieve the above pressure change, the following measures may be taken. The compact pressure P is detected during the step S3 of ejecting the compact 7. When the detected compact pressure P is as low as the preset level $P_X$ the operation of the upper punch 3 and/or the lower punch 4 may be restricted, to stop the increase of the distance between the punches. If this control can be realized, detaching fracture can be prevented without fail regardless of when the compact pressure P reaches the predetermined level $P_X$ as a result of the minimal-speed lift of the upper punch 3, at time $t_{41}$, $t_{42}$, or $t_{43}$.

In order to realize the above control, the compact pressure P must be detected real time with high precision. Since the pressure $P_X$ is extremely small compared with the compact pressure $P_C$, it is difficult to precisely detect whether or not the compact pressure P has dropped to the level of the pressure $P_X$ by a conventional method employed in the case of using hydraulic cylinders for driving the punches and the die where the compact pressure P is calculated by detecting the hydraulic pressure.

In the embodiment of the present invention, a strain sensor (strain gage) (not shown) may be stuck to the upper punch 3 with an adhesive, so that the compact pressure P is detected based on the magnitude of the strain of the upper punch 3. Such a strain sensor is preferably secured to the periphery of an end portion of the punch. The strain sensor can precisely measure the strain at the end of the punch during pressing. This makes it possible to detect the pressure applied to the compact real time with high precision. As the strain sensor, a strain gage FCA-3-11-1L manufactured by Tokyo Sokki Kenkyujo Co., Ltd. may be used. A larger number of strain gages can provide a more precise pressure value. In this embodiment, a 4-gage method is adopted and four strain gages are stuck to the periphery of the punch for measuring the absolute of the strain of the upper punch 3 in two directions, for example, in the directions parallel and perpendicular to the axial direction. The strain gages may be stuck to the periphery of the upper punch 3 and/or the periphery of the lower punch 4.

Figure 12:
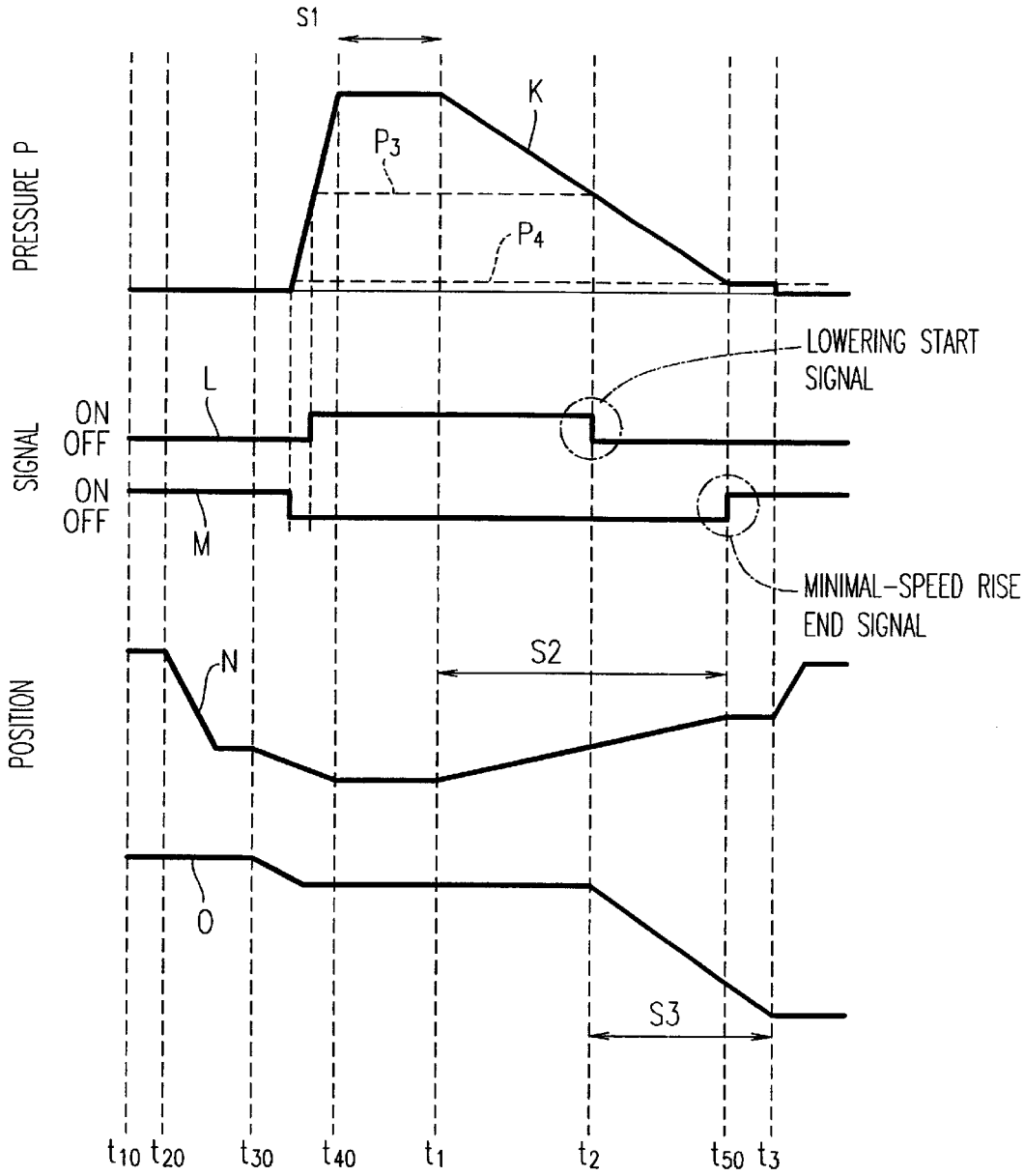
FIG. 12 is a view illustrating the pressure P applied to the compact (line K), the outputs of a pressure detection circuit (lines L and M), and the positions of the upper punch 3 (line N) and the die 2 (line O) in an embodiment of the present invention where the pressure applied to the compact is detected with a strain sensor attached to a punch for pressure control.

Hereinafter, an example of the pressure detection/control method will be described with reference to FIG. 12. In FIG. 12, line K represents the pressure P applied to the compact 7 from the upper punch 3. Lines L and M represent signals used for control of operations of the die 2 and the upper punch 3, respectively. These signals are output from a control signal output section coupled to a strain sensor. Lines N and O represent the positions of the upper punch 3 and the die 2, respectively.

First, from time $t_{10}$ to time $t_{20}$, both the die 2 and the upper punch 3 are unmoved. During time $t_{20}$ to time $t_{30}$, the die 2 is kept unmoved, but the upper punch 3 is lowered. During time $t_{30}$ to time $t_{40}$, the die 2 is lowered, and the upper punch 3 is also lowered at a speed twice that of the lowering of the die 2. As a result, the die 2 applies downward friction to the periphery of the filled powder, and thus the filled powder is pressed against the lower punch 4. This provides substantially the same pressure effect as that obtained when the lower punch 4 is lifted while the upper punch 3 is lowered, and is effective in reducing a variation in density of the resultant compact.

At time $t_1$, the step S2 of lifting the upper punch at a minimal speed is started. The pressure P monotonously decreases as shown by line K. With the decrease of the pressure P, the strain of the upper punch 3 decreases, which is detected by the sensor attached to the upper punch 3.

In this embodiment, the control signal output section is set to turn the output signal L to the ON state when the absolute of the strain of the upper punch 3 exceeds the absolute of a strain corresponding to a preset first pressure level $P_3$. The control signal output section is also set to turn the output signal M to the ON state when the absolute of the strain of the upper punch 3 is less than the absolute of a strain corresponding to a preset second pressure level $P_4$. By these settings, when the compact pressure P decreases as a result of the minimal-speed lift of the upper punch, the time point at which the compact pressure P reaches the first pressure level $P_3$ can be detected from the shift of the state of the signal L. Likewise, in the course of further decrease of the compact pressure P, the time point at which the compact pressure P reaches the second pressure level $P_4$ can be detected from the shift of the state of the signal M.

In the example shown in FIG. 12, the lowering of the die 2 at the start of step S3 is started when the signal L shifts from the ON state to the OFF state, and the minimal-speed lift of the upper punch 3 is halted when the signal M shifts from the OFF state to the ON state. This delicate operation control based on the change of the pressure P can be realized with precision by directly measuring the strain of the upper punch 3 real time.

By use of the strain sensor as described above, also, it is possible to apply the predetermined compact pressure $P_C$ to the powder even when the amount of the powder in the cavity varies. This provides an additional advantage of producing a compact having a desired compacting density.

In this embodiment, the signals L and M shown in FIG. 12 were used for the detection of whether or not the compact pressure P has reached a predetermined level, as an example. Alternatively, constructions that output other signals may also be adopted.

In this embodiment, also, the pressure applied to the powder (or the compact) in the cavity was directly measured using a strain sensor, and based on the measurement results, the pressure to be applied to the compact was controlled. Alternatively, in the case where the variation in the amount of filled powder is small between cycles, the control of the pressure to be applied to the compact can be done by use of a position sensor capable of measuring the position of the upper punch 3 or the die 2 with high precision. In the case of using a position sensor, the lowering of the die 2 may be started when the position of the upper punch 3 reaches a first position level as a result of its minimal-speed lift, and thereafter, the minimal-speed lift of the upper punch 3 may be halted when the position of the upper punch 3 reaches a second position level as a result of its continued minimal-speed lift.

Next, the relationship between the detaching fracture of the compact and the particle size distribution will be described.

Figure 13:
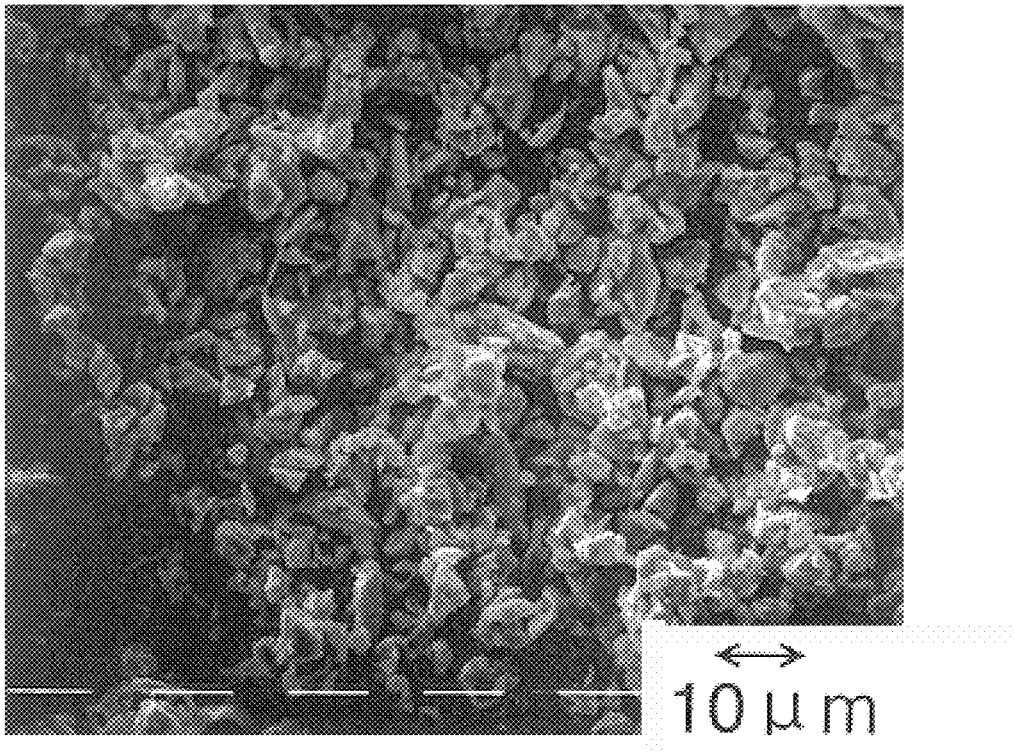
FIG. 13 is an enlarged photograph of R-Fe-B alloy powder produced by strip casting.

Production of R-Fe-B alloy powder by ingot casting arises such problems that crystal grains are coarse and that α-Fe is remained and segregated. In recent years, therefore, attention has been focused on quenching techniques (cooling rate: $10^2$ to $10^{4}$° C./sec) such as strip casting, typically, as a superseder of the ingot casting. Strip casting can provide fine crystal structures, and thus can solve the above problem. Details of production of a R-Fe-B alloy by strip casting are disclosed in U.S. Pat. No. 5,383,978, for example. R-Fe-B alloy powder formed by strip casting has an angular shape as shown in FIG. 13.

Figure 14:
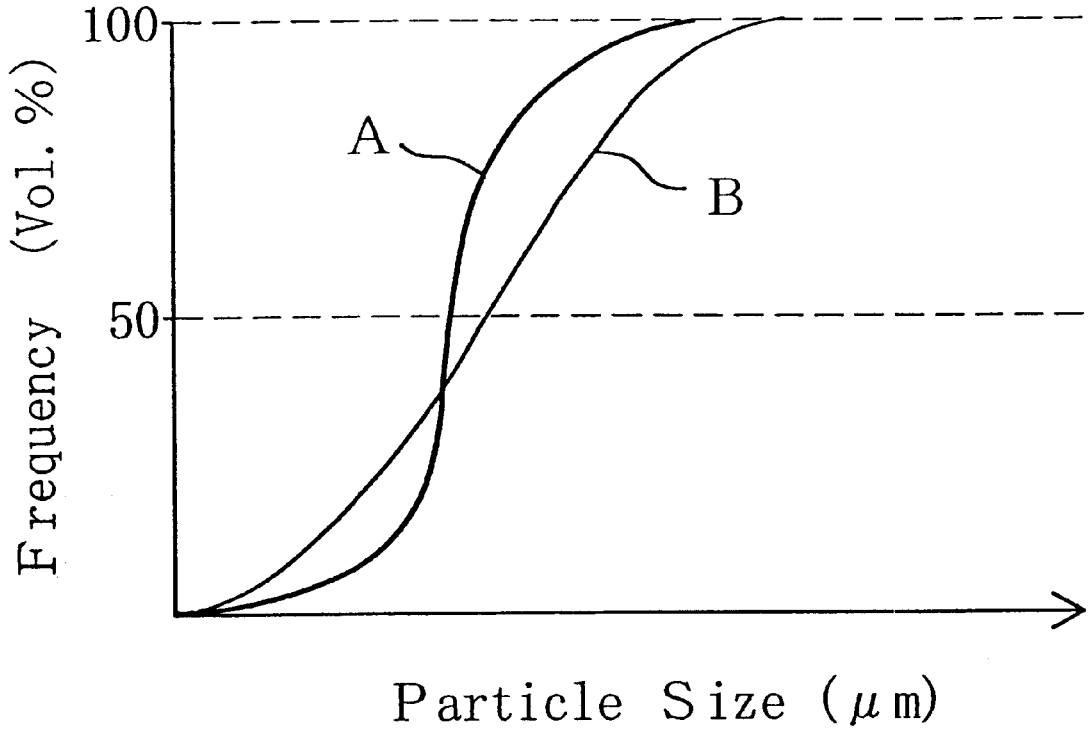
FIG. 14 is a graph showing powder particle size distributions A and B of rare earth magnet alloys produced by strip casting and ingot casting, respectively.

The particle size distribution of alloy powder produced by strip casting is shown in FIG. 14. FIG. 14 is a graph showing the results of measurement with a laser particle size distribution meter, where the x-axis represents the particle size and the y-axis represents the cumulative frequency of particles having sizes equal to or less than a given value. Curve A in FIG. 14 represents the particle size distribution of powder produced by strip casting. For comparison, the particle size distribution of powder produced by conventional ingot casting is shown by curve B.

As is observed from FIG. 14, the powder produced by strip casting is small in mean particle size and small in particle size variation (narrow in particle size distribution), compared with the powder produced by ingot casting. More specifically, the particle sizes $D_{50}$ and $D_{99}$ of powder particles used in this example of the present invention are 4.5 μm or less and 15.0 μg m or less, respectively. Herein, the value of $D_{50}$ indicates that 50% of particles by volume have particle sizes equal to or less than this value, and the value of $D_{99}$ indicates that 99% of particles by volume have particle sizes equal to or less than this value. Note that the percentage by volume is equal to the percentage by weight if there is no dependency of the particle size on the composition ratio.

Powder having the particle size distribution represented by curve A is narrower in particle size distribution than powder having the particle size distribution represented by curve B. Therefore, the resultant compact is less likely to be tightened during compaction and thus more likely to cause springback. For this reason, when the powder produced by strip casting is used, the powder compact is likely to be detached. As a result, in the conventional method, it becomes difficult to avoid generation of both detaching and buckling of the compact.

As is apparent from the above, the method for producing a compact according to the present invention especially exhibits a significant effect when alloy powder produced by strip casting is used for production of a compact.

Thus, according to the present invention, a compact in the shape of a rod or a cylinder can be produced with good yield evading generation of detaching or buckling. The present invention is therefore suitable for manufacture of a radially-aligned magnet elongated in the axial direction.

Conventionally, in the manufacture of a thin-plate magnet by compaction, a punch is driven in the direction parallel to the plate thickness direction. In this case, the direction of the magnetic field applied for alignment is parallel to the direction of the movement of the punch (pressing direction). However, it is known that better magnet properties are obtained when the magnetic field for alignment is applied in the direction perpendicular to the pressing direction, than in the direction parallel to the pressing direction. Therefore, compaction is desirably performed so that the plate thickness direction and the direction of the magnetic field for alignment are perpendicular to the pressing direction. If compaction is performed in this way using the conventional method for producing a compact, the buckling strength of the resultant compact is low since the compact is in such a position that will easily generate buckling during the ejection of the compact, and thus the compact will easily collapse. According to the present invention, however, a thin-plate compact in the position that will easily generate buckling can be produced without generating buckling by optimizing the pressure control during the ejection of the compact. This makes it possible to manufacture a thin-plate magnet having excellent magnetic properties that could not have been obtained by the conventional method.

Hereinafter, an example of the method for manufacturing a magnet according to the present invention will be described.

First, powder of a rare earth alloy produced by a known method was prepared. Cast pieces of a R-Fe-B rare earth magnet alloy were produced by strip casting. More specifically, an alloy having a composition of Nd: 30 wt. %, B: 1.0 wt. %, Dy: 1.2 wt. %, Al: 0.2 wt. %, Co: 0.9 wt. %, and Fe and unavoidable impurities as the remainder was melted by high-frequency melting, to obtain alloy molten mass. The alloy molten mass, which was kept at 1350° C., was then quenched by a single roll method, to obtain alloy cast flakes having a thickness of 0.3 mm. This quenching was performed under the conditions of the roll peripheral velocity of about 1 m/sec, the cooling rate of 500° C./sec, and the degree of undercooling of 200° C.

The thus-obtained quenched alloy flakes were roughly pulverized by hydrogen absorption, and then finely pulverized in a nitrogen gas atmosphere with a jet mill, to obtain alloy powder having a mean particle size of about 3.5 μm.

Thereafter, 0.3 wt. % of a lubricant is added to and mixed with the above alloy powder in a rocking mixer, to coat the alloy powder particles with the lubricant. As the lubricant, preferably used is a fatty ester diluted with a petroleum-based solvent. In this example, methyl caproate was used as the fatty ester and isoparaffin was used as the petroleum-based solvent. The weight ratio of methyl caproate to isoparaffin was set at 1:9, for example. This type of liquid lubricant advantageously coats the surfaces of the powder particles, and protects the particles from being oxidized, suppressing disorder of the alignment of the compact.

The lubricant is not limited to that described above. Examples of the fatty ester usable other than methyl caproate include methyl caprylate, methyl laurylate, and methyl laurate. Examples of the solvent usable other than isoparaffin include other petroleum-based solvents and naphthenic solvents. The lubricant may be added at any timing before, during, or after the fine pulverization. In place of the liquid lubricant, or in addition to the liquid lubricant, a solid lubricant such as zinc stearate may also be used.

Thereafter, the powder obtained was filled in a cavity of a press having a construction as shown in FIG. 1, and operation as shown in FIG. 6 was performed to produce a compact. For easy ejection of the compact from the cavity, the liquid lubricant described above may be applied, before filling of the powder, to portions of the press that are to be in contact with the powder, such as the through hole of the die and the end faces of the upper and lower punches.

The size of the compact produced was 70 mm×118 mm×80.7 mm (height). The compacting density was 4.3 g/cm$^3$, the compact pressure was about 70 MPa, and the filled amount was 2,870 g. During the compaction, a magnetic field for alignment in the direction perpendicular to the pressing direction was applied.

In this example, the time was counted with a timer from time $t_1$ to time $t_2$ (see, FIG. 6). When a preset time $T_{SET}$ has elapsed from time t1, the step S3 of ejecting the compact was started. The preset time $T_{SET}$ (=$t_2$−$t_1$) was changed in the range of 6.0 to 90 seconds as shown in Table 1 below, and the compaction states of the resultant compacts were evaluated. The evaluation results are shown in the rightmost column of Table 1.

TABLE 1

| Sample | Ejecting start Timing $t_2$−$t_1$ (sec) | Pressure at start of ejecting step $P_3$ (Pa) | Pressure at start of upper punch high-speed lift step $P_4$ (Pa) | Compaction state |
|---|---|---|---|---|
| 1 | 6.0 | 11.27 | — | Collapsed |
| 2 | 7.0 | 8.43 | — | Good |
| 3 | 8.0 | 5.78 | — | Good |
| 4 | 9.0 | 3.53 | — | Detached |

In this example, the minimal-speed lift of the upper punch was continued for about 15 seconds, and the compact ejecting step was continued for about 9 seconds. The compact pressure $P_4$ was as small as less than the measurable limit at the time point ($t_3$) at which the ejecting step has been completed and the high-speed lift of the upper punch 3 is started.

As is found from Table 1, no detaching or collapse was observed in samples 2 and 3, exhibiting good compaction states. In sample 1, however, collapse was generated in the compact. This is presumably because the timing of the start of the ejecting step was so early that most or the entire of the compact was ejected from the die while the compact pressure P (=$P_3$) had not yet sufficiently decreased. In sample 4, detaching was generated, presumably because the timing of the start of the ejecting step was so late that the compact pressure P (=$P_3$) was too low at the start of the ejecting step to suppress the springback of the compact sufficiently.

For comparison, the compaction states of compacts produced according to the conventional operation shown in FIG. 2 was evaluated. The evaluation results are shown in Table 2.

TABLE 2

| Sample | Ejecting start Timing | Pressure at start of ejecting step $P_3$ (Pa) | Pressure at start of upper punch high-speed lift step $P_4$ (Pa) | Compaction state |
|---|---|---|---|---|
| 5 | After halt of minimal-speed lift | 2.55 | 1.08 | Collapsed |
| 6 | After halt of minimal-speed lift | 1.57 | 0.69 | Detaching/ Collapsed |
| 7 | After halt of minimal-speed lift | 0.88 | 0.88 | Detaching |

In this comparative example, the ejection of the compact was started after the halt of the minimal-speed lift of the upper punch. In samples 5, 6, and 7, the distances by which the upper punch was lifted at a minimal speed were 1.26 mm, 1.395 mm, and 1.530 mm, respectively.

As is found from Table 2, in sample 5 where the distance of the minimal-speed lift of the upper punch was comparatively small, the pressure applied to the compact during the ejecting step (holding pressure $P_H$) was too large. As a result, collapse was generated. In sample 7 where the distance of the minimal-speed lift of the upper punch was comparatively large, the holding pressure $P_H$ was too small. As a result, detaching was generated. In sample 6 where the distance of the minimal-speed lift of the upper punch was in the middle between those of samples 5 and 7, both detaching and collapse were generated.

Therefore, in the conventional method, where the substantially constant holding pressure $P_H$ is kept applied to the compact from the start to the end of the ejecting step, a compact having good compactibility will not be obtained when the compact has a large compact height or a low compacting density.

The compacts obtained were sintered at 1000° C. to 1100° C. for 2 hours to 8 hours, to obtain sintered magnets. The magnets manufactured from samples 2 and 3 exhibited good magnet properties.

In the above example, the compacting density was 4.3 g/cm$^3$. It is considered that the present invention is especially effective when the compacting density is in the range of 3.8 g/cm$^3$ to 5.0 g/cm$^3$ and when the ratio of the compact height L to the minimum size D of the compaction face (L/D) is 0.5 or more.

Thus, according to the present invention, it is possible to optimize the compact pressure during the ejection of a pressed compact from the die. Therefore, generation of detaching or collapse of the compact can be effectively avoided. This makes it possible to produce with good yield even a compact having a large compact height with respect to the compaction area, such as a rod-shaped compact or a cylindrical compact. In particular, in the case of manufacturing an anisotropic magnet, detaching and collapse tend to be generated conventionally because the compacting density is comparatively low and the powder used has a particle size distribution that is susceptible to springback. This problem can be solved by use of the method of the present invention.

The powder press of the present invention can detect with precision the pressure applied to a compact from the punch. This makes it possible to realize delicate pressure control that is required during the ejection of the compact from the die.

While the present invention has been described in a preferred embodiment, it will be apparent to those skilled in the art that the disclosed invention may be modified in numerous ways and may assume many embodiments other than that specifically set out and described above.

Accordingly, it is intended by the appended claims to cover all modifications of the invention which fall within the true spirit and scope of the invention.

What is claimed is:

1. A method for producing a powder compact using an apparatus comprising a die having a through hole forming at least a portion of a cavity and first and second punches for compacting powder in the through hole, the method comprising the steps of:

filling the cavity with the powder wherein at least an end portion of the second punch is located in the through hole of the die;

inserting at least an end portion of the first punch in the through hole of the die;

compacting the powder between the first and second punches to form a powder compact;

increasing a distance between the first and second punches, thereby decreasing the pressure on the powder compact; and ejecting the powder compact from the through hole of the die by starting relative movement of the die with respect to the powder compact after the decrease of the pressure is started and before the decrease of the pressure is halted, wherein the pressure continuously decreases through at least a predetermined period that expires when a top end portion of the powder compact is exposed outside from the die.

2. The method of claim 1, wherein said step of ejecting the powder compact is initiated when a first time has elapsed from a time at which said step of increasing the distance between the first and second punches is started.

3. The method of claim 1, wherein said step of ejecting the powder compact is initiated when the pressure has dropped to a first level.

4. The method of claim 1, further comprising the step of holding the second punch immobile during said step of ejecting the powder compact.

5. The method of claim 1, further comprising the step of holding the die immobile during said step of ejecting the powder compact.

6. The method of claim 1, wherein said step of increasing the distance between the first and second punches is halted when the pressure drops to a second level.

7. The method of claim 1, further comprising the step of detecting the pressure using the output of a strain sensor attached to at least one of the first and second punches.

8. The method of claim 1, wherein the powder is magnet powder.

9. The method of claim 8, wherein the magnet powder is rare earth alloy powder having a mean particle size of 5 82 m or less.

10. The method of claim 9, further comprising the step of producing the magnet powder by quenching alloy molten mass.

11. The method of claim 8, further comprising the step of adding a lubricant to the powder.

12. A method for producing a magnet comprising the steps of:

producing a powder compact by the method of claim 1; and sintering the powder compact.

13. The method of claim 12, further comprising the step of applying a magnetic field for alignment to the powder during said step of compacting the powder between the first and second punches.

14. The method of claim 13, wherein said step of applying a magnetic field is effected with the magnetic field in a direction substantially perpendicular to a pressing direction of the first and second punches against the compact.

15. A method for manufacturing a magnet using an apparatus comprising a die, a first punch, and a second punch for compacting magnet powder, the method comprising the steps of:

compacting the magnet powder between the first and second punches to form a powder compact;

increasing a distance between the first and second punches, thereby decreasing the pressure applied to the powder compact from the first and second punches; and ejecting the powder compact from the die by starting relative movement of the die with respect to the powder compact after the decrease of the pressure is started and before the decrease of the pressure is halted, wherein the pressure continuously decreases through at least a predetermined period that expires when a top end portion of the powder compact is exposed outside from the die.

16. The method of claim 15, further comprising the step of generating a magnetic field for alignment having a direction perpendicular to a pressing direction of the first and second punches against the powder compact while effecting said step of compacting the magnet powder with the first and second punches.

17. The method of claim 16, wherein said step of compacting the powder between the first and second punches produces a powder compact in a plate shape wherein the size of the compact measured in the direction parallel to the direction of the magnetic field for alignment is smaller than a size measured in any other direction.

18. A powder press, comprising:

a die having a through hole forming at least a portion of a cavity;

a first punch and a second punch, said punches each comprising end portions, with said end portion of said second punch forming a portion of the cavity;

filling means for filling said cavity with the powder;

positioning means for positioning at least said end portion of said first punch in said through hole of said die and compacting the powder in said die between said first and second punches, forming a powder compact;

wherein said positioning means increases a distance between said first and second punches while applying a pressure to the powder compact from said first and second punches, thereby decreasing the pressure on the powder compact, and ejects the powder compact from said die by starting relative movement of said die with respect to the compact after the decrease of said pressure is started and before said pressure drops to a first level, and completing ejection of the powder compact from the through hole of said die while said pressure is at the first level, wherein said positioning means is adapted to continuously decrease the pressure through at least a predetermined period that expires when a top end portion of the powder compact is exposed outside from the die.

19. The powder press according to claim 18, wherein said positioning means is adapted to initiate the relative movement of said die with respect to the compact when a first time has elapsed from a time point at which said press initiates increase of the distance between said first and second punches.

20. The powder press according to claim 18, wherein said positioning means is adapted to initiate the relative movement of said die with respect to the powder compact when the pressure drops to a first level by increasing the distance between said first and second punches.

21. The powder press according to claim 18, wherein said positioning means is adapted to eject the powder compact from said die while holding said second punch immobile.

22. The powder press according to claim 18, wherein said positioning means is adapted to eject the powder compact from said die while holding said die immobile.

23. The powder press according to claim 18, wherein said positioning means is adapted to halt the increase of the distance between said first and second punches when said pressure drops to a second level.

24. The powder press according to claim 18, further comprising a strain sensor attached to at least one of said first and second punches for detecting the pressure applied to the powder by said punch.

25. The method of claim 1, wherein the ejection of the powder compact from the through hole of the die is completed before the pressure becomes zero.

26. The method of claim 15, wherein the ejection of the powder compact from the through hole of the die is completed before the pressure becomes zero.

27. The method of claim 1, wherein the top end portion of the powder compact is exposed outside from the die while the pressure is decreasing.

28. The method of claim 15, wherein the top end portion of the powder compact is exposed outside from the die while the pressure is decreasing.

29. The powder press according to 18, wherein the top end portion of the powder compact is exposed outside from the die while the pressure is decreased.

* * * * *